US006328424B1

(12) United States Patent
Denton et al.

(10) Patent No.: US 6,328,424 B1
(45) Date of Patent: Dec. 11, 2001

(54) INKJET CARTRIDGE WITH SIMULTANEOUS ELECTRICAL AND FLUID CONNECTIONS

(75) Inventors: Gary Allen Denton; William Paul Cook, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/593,104

(22) Filed: Jun. 13, 2000

(51) Int. Cl.[7] ..... B41J 2/01
(52) U.S. Cl. ..... 347/50
(58) Field of Search ..... 347/85, 86, 87, 347/49, 50

(56) References Cited

U.S. PATENT DOCUMENTS

| | | | | |
|---|---|---|---|---|
| 4,628,332 | * | 12/1986 | Matsumoto | 347/49 |
| 4,831,389 | | 5/1989 | Chan | 347/86 |
| 5,509,140 | | 4/1996 | Koitabashi et al. | 347/86 |
| 5,621,446 | | 4/1997 | Tanaka et al. | 347/85 |
| 5,742,312 | | 4/1998 | Carlotta | 347/87 |
| 5,757,390 | | 5/1998 | Gragg et al. | 347/7 |
| 5,788,388 | * | 8/1998 | Cowger et al. | 400/703 |
| 5,790,157 | | 8/1998 | Higuma et al. | 347/85 |

FOREIGN PATENT DOCUMENTS 0 719 646 7/1996 (EP) .

* cited by examiner

*Primary Examiner*—N. Le
*Assistant Examiner*—Michael P. Nghiem
(74) *Attorney, Agent, or Firm*—B. Franklin Griffin, Jr.

(57) ABSTRACT

A refillable cartridge for inkjet printing devices having an ink cartridge carrier is characterized in that it is filled with an ink supply and tested prior to shipment, is open to ambient pressure during shipment and storage, requires no handling of the ink supply line during installation on, or removal from, a cartridge carrier, and permits simultaneous fluid and electrical connections to the cartridge as it is installed. Partitions divide the interior of the cartridge into a free ink reservoir, a foam-filled ink reservoir and an air buffer region. An ink passage permits ink flow in either direction between the ink reservoir and the foam-filled ink reservoir. A tab circuit is secured to one side wall of the cartridge and this wall is provided with an opening through which a hollow ink supply needle, mounted on the cartridge carrier, may extend so as to supply replenishment ink to the free ink reservoir during printing. In one embodiment the opening is a vent opening and one of the partitions is provided with a refill opening axially aligned with the vent opening and sealed by an elastic barrier. In this case the cartridge carrier is provided with a boss and O-ring surrounding the ink supply needle for closing the vent opening as the cartridge is installed on the carrier. In a second embodiment the opening in the cartridge side wall is sealed by an elastic barrier and a separate vent opening is provided for admitting ambient pressure to the air buffer region during shipment and storage. The carrier is provided with a boss and o-ring for sealing the vent opening as the needle pierces the elastic barrier. In both embodiments, the carrier carries a flexible flat cable that makes electrical contact with the tab circuit as the cartridge is installed on the carrier.

9 Claims, 3 Drawing Sheets

INKJET CARTRIDGE WITH SIMULTANEOUS ELECTRICAL AND FLUID CONNECTIONS

RELATED APPLICATIONS

This application is related to our copending application Ser. No. 09/074,215, now U.S. Pat. No. 6,095,643, entitled Refillable Disposable Inkjet Cartridge, the disclosure of which is incorporated herein by reference.

FIELD OF THE INVENTION

The present invention relates to a disposable ink jet cartridge for use on devices of the type having an ink supply located off-board the printhead carrier for continuously replenishing ink in the cartridge via a siphon system. The cartridge is characterized in that it has a refill opening disposed on the same side wall that carries the tab circuit so that fluid connection of the cartridge to an off-board ink supply is accomplished at the same time an electrical connection is made to circuits controlling the cartridge.

BACKGROUND OF THE INVENTION

The assignee of the present invention currently manufactures an ink jet cartridge for use on wide format inkjet plotters having a large off-carrier ink supply and an ink supply hose through which ink is siphoned from the off-carrier supply to continuously replenish an ink reservoir in the cartridge. The cartridge ink reservoir has an opening extending through a female part of a Luer-Lock fitting. The ink supply hose is connected to one end of an opening in the male part of the fitting and an elongated hollow needle extends from the other end of this opening. When the cartridge is installed on the printhead carrier and the two parts of the fitting are mated, ink is siphoned from the off-carrier ink supply into the cartridge reservoir to replace ink drawn from the cartridge reservoir during printing.

The currently manufactured cartridge has a disadvantage in that it can not be filled and tested prior to shipment from the factory. If the opening into the ink reservoir is left open, ink leaks from the cartridge during shipment and storage. On the other hand, the opening can not be closed by a temporary cap because changes in the ambient temperature or pressure during shipment or storage either causes air bubbles to be drawn into the cartridge through apertures in the nozzle plate, or causes ink to be forced from the apertures. Therefore, the presently manufactured cartridge is shipped empty and untested from the factory. Prior to use a customer must fill, prime and test the cartridges. The process is messy, error prone and costly in that many cartridges fail to print properly.

In our copending application Ser. No. 09/074,215 now U.S. Pat. No. 6,095,643 we solve the aforementioned problems by providing a cartridge having partitions dividing the interior of the cartridge into a free ink reservoir communicating with a foam-filled ink reservoir via a passage in one of the partitions, and an air buffer region, the air buffer region being open to the foam filled ink reservoir. The fitting that connects the cartridge to an off-board ink supply is located in the lid or top cover of the cartridge so that when the cartridge is not connected to the off-board ink supply the air buffer region is open to the atmosphere. One of the partitions has an opening therein, aligned with the opening in the fitting, and closed by an elastic septum so that when the fitting is connected to an off-board ink supply the hollow needle extends into the free ink reservoir.

While this solves the problem of ink leakage during shipment and storage, it still requires handling of the ink supply line because cartridges do have to be replaced due to wear of the apertures through which ink is ejected. For obvious reasons it would be advantageous if the user did not have to handle the ink supply line during cartridge replacement.

Furthermore, the cartridge described in our above-mentioned application, like many cartridges using an off-board ink supply, requires two steps to install it in a printer. The ink supply must be connected to the cartridge and electrical connections must be established to the heaters on the cartridge which heat the ink to control ejection of ink during printing. The electrical connections are established at the time the cartridge is mounted on the printhead carrier by providing a tab circuit with contacts on an outer surface of a side wall of the cartridge, these contacts being brought into engagement with contacts provided on the printhead carrier as the cartridge is mounted on the carrier.

SUMMARY OF THE INVENTION

An object of the present invention is to provide a continuously refillable ink cartridge suitable for use with an off-board ink replenishment system, the cartridge being characterized in that electrical and fluid connections to the cartridge are simultaneously established as the cartridge is mounted on a cartridge carrier.

Another object of the invention is to provide a refillable ink cartridge suitable for use with an off-board ink replenishment system, the cartridge requiring no handling of the ink supply line as the cartridge is installed or removed.

A further object of the invention is to provide a refillable ink cartridge that may be filled with ink, primed and tested prior to shipment from the factory, the cartridge permitting simultaneous electrical and fluid connections thereto as it is installed on a cartridge carrier.

A refillable ink cartridge according to the invention has an interior divided by partitions into a free ink reservoir, a foam-filled ink reservoir, and an air buffer region; an ink passage permitting flow of ink between the foam-filled ink reservoir and the free ink reservoir; and heaters mounted on a first outer wall for ejecting ink from the free ink reservoir during printing, the cartridge having a tab circuit mounted on a second outer wall and connected to the heaters; the second outer wall having an opening therein through which replenishment ink may be drawn into the free ink reservoir during printing. In a first embodiment, the opening is a vent opening for admitting ambient pressure to the air buffer region during shipment and storage of the cartridge, the cartridge having a refill opening in one of the partitions separating the air buffer region from the free ink reservoir, the refill opening being axially aligned with the vent opening and sealed by a pierceable elastic barrier. In a second embodiment, the opening is sealed with a pierceable elastic barrier, and the cartridge is provided with a vent opening in the second wall for admitting ambient pressure to the air buffer region during shipment and storage of the cartridge.

A further object of the invention is to provide a cartridge according to the first or second embodiment in combination with a cartridge carrier having a flexible flat cable which is brought into electrical contact with the tab circuit as the cartridge is installed on the carrier, an ink supply needle which pierces the elastic barrier as the cartridge is installed, and a boss and O-ring for sealing the vent opening.

Other objects and advantages of the invention will become obvious upon consideration of the following description and the accompanying drawings.

DESCRIPTION PREFERRED EMBODIMENTS

Figure 1:
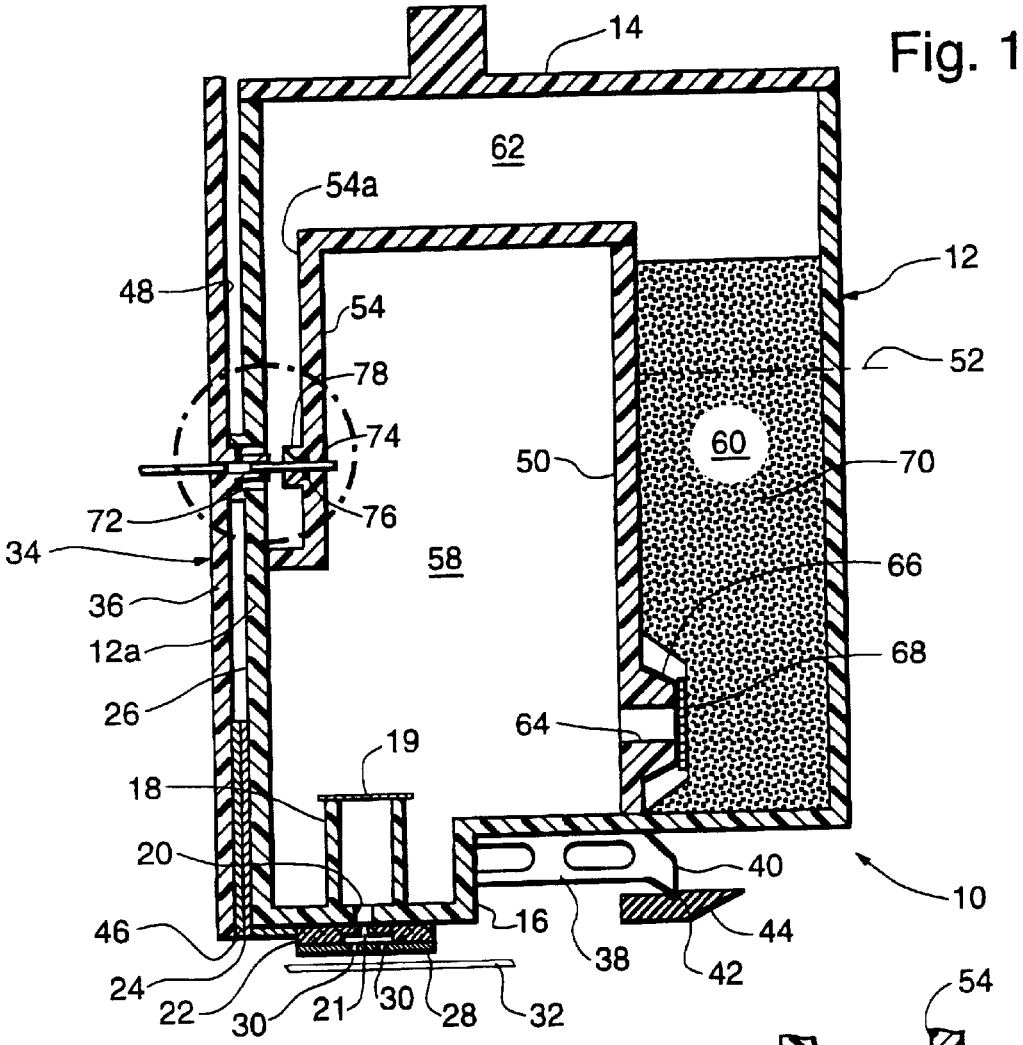
FIG. 1 is a sectional view of a first embodiment of the invention wherein a single opening is provided in the cartridge wall, the opening serving to vent the cartridge to the ambient environment during shipment and storage, and provide a passage through which replenishment ink may pass when the cartridge is in use.

FIG. 1 shows a ready-to-use ink cartridge 10 suitable for use in a printer or plotter wherein ink is siphoned from an ink supply or reservoir located off-board the cartridge carrier. The ink cartridge 10 is conventional in that it comprises a hollow plastic cartridge body 12 having a top cover or lid 14. Cartridge body 12 is molded so as to have a downwardly extending nose portion 16 and a stand pipe 18 extending upwardly from the bottom of the nose portion. The cartridge 10 has a first opening 20 extending through the nose portion 16 of body 12. This opening serves as an ink passage which permits the flow of ink from the bottom of stand pipe 18 to capillary ink passages 21 in a heater chip 22 secured to the bottom surface of the nose portion. A tab circuit 24, is secured to the outer surface 26 of cartridge wall 12*a* and extends underneath the nose portion 16. The tab circuit carries printed circuits which connect heaters in the heater chip to a source of energizing signals when the cartridge is mounted on a cartridge carrier. As the heaters are energized, ink is ejected from the capillary ink passages through nozzles or apertures 30 in a nozzle plate 28 to cause printing. The heaters cool when the energizing signals terminate and this draws ink into the capillary ink passages from the stand pipe through the ink passage 20.

FIG. 1 shows cartridge 12 mounted on a cartridge carrier 34. The cartridge carrier has a vertical leg 36 and a horizontally extending portion 38 for supporting cartridge 10. The carrier is slidably supported in a conventional manner on a shaft (not shown) so that it may be pulled back and forth in a direction normal to the plane of FIG. 1. The carrier is free to pivot on its support shaft so its horizontally extending portion 38 is provided with a foot 40 which rides in a groove 42 in a guide bar 44 to limit clockwise movement of the carrier on its shaft and set the distance between nozzle plate 28 and the record medium 32 on which printing takes place. It will be appreciated that a mechanism, such as a snap lock, or other feature would be used to maintain mechanical alignment between the cartridge 12 and carrier 34.

A flexible flat cable 46 is secured to the carrier in a conventional manner. As is well known in the art, cable 46 has conductors therein terminating at pads disposed adjacent the surface 48 of vertical leg 36 so that the pads make contact with circuits in tab circuit 24 when cartridge 10 is mounted on the carrier, thereby establishing electrical connections between the heaters on the cartridge and control circuits (not shown) located off-board the carrier.

According to a first embodiment of the invention, the cartridge 10 and cartridge carrier 34 are modified as follows. The cartridge body 12 is provided with partitioning walls 50 and 54 dividing the interior of the body into a free ink reservoir 58, a foam-filled ink reservoir 60 and an air buffer region 62. An ink passage 64 extends through wall 50 to permit the free flow of ink in either direction between the free ink reservoir 58 and the foam-filled ink reservoir 60. Walls 50 and 54 may be made of the same plastic material as cartridge body 12 and secured in place by any suitable method such as heat staking.

Foam material 70, disposed in reservoir 60, is a conventional hydrophobic foam material and may, for example, be polyurethane open cell foam. Preferably, the ink passage 64 extends through a boss 66 and is covered by a filter 68 to prevent air and particles of foam material 70 from migrating into the free ink reservoir. A filter 19 is provided over the stand pipe 18 to prevent foam particles from migrating through the stand pipe and opening 20 so as to block the flow of ink through capillary ink passages 21.

Figure 2:
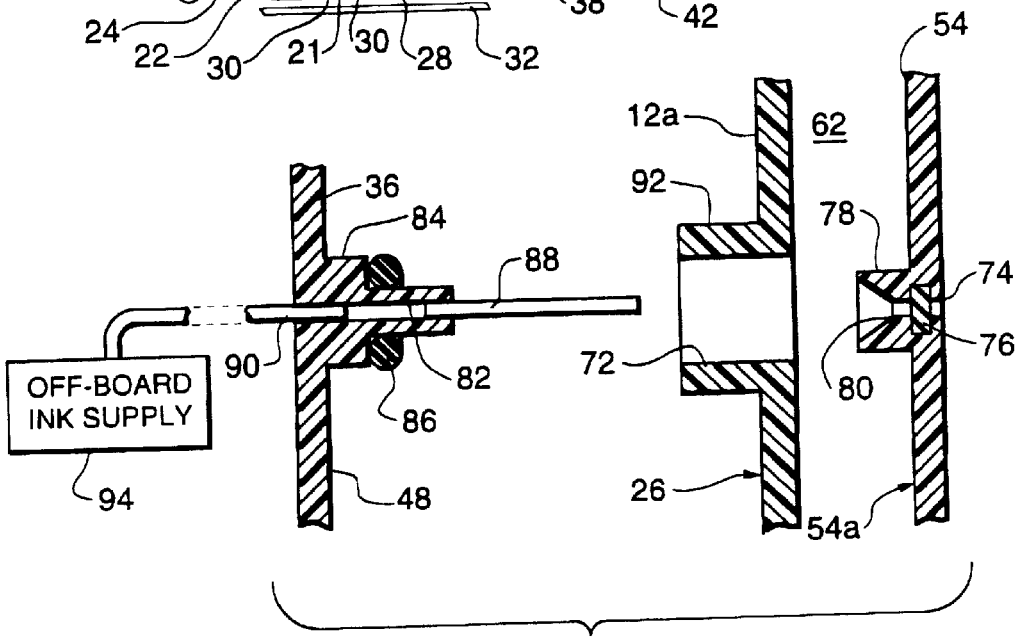
FIG. 2 is an enlarged view of the circled portion of FIG. 1.

Referring to FIGS. 1 and 2, the cartridge body is provided with a vent opening 72 extending through wall 12*a* and a refill opening 74 axially aligned with the vent opening and extending through the partitioning wall 54. The surface 54*a* of wall 54 is recessed and a pierceable barrier 76 is disposed in the recess to seal refill opening 74. The pierceable barrier 76 may be an elastic septum made of rubber or any other material having sufficient elasticity to reclose a pierced opening. A needle guide 78 is mounted on surface 54*a,* the needle guide having a through-hole 80 that is axially aligned with vent opening 72 and refill opening 74. The through-hole 80 widens or flairs outwardly in the direction of vent opening 72 so that a hollow flexible needle 88 passing through opening 72 from left to right is guided into refill opening 74.

The vertical leg 36 of carrier 34 is provided with a through-hole 82 disposed such that when the cartridge 10 is mounted on cartridge carrier 34 the hole is axially aligned with refill opening 74. Surface 48 of the carrier vertical leg 36 has a stepped boss 84 through which hole 82 extends. The large diameter portion of boss 84 is made slightly smaller than the hole 72 so that the boss slides into the hole as the cartridge is moved to its fully installed position on the carrier. An O-ring 86 surrounds the smaller diameter portion of boss 84 to provide an air-tight seal between the exterior surface of boss 84 and the interior surface of boss 92 surrounding the refill opening 72.

A hollow needle 88 is inserted into hole 82 from one end and a flexible ink supply tube 90 is inserted from the opposite end. Ink supply tube 90 is connected to an off -board ink supply 94 that is disposed slightly lower than the refill opening 72 so that a slight negative pressure is maintained in the supply tube. Needle 88 is made long enough so that as the cartridge 10 is installed on carrier 34, the needle passes through refill opening 72, the air buffer region 62 and needle guide 78 so as to pierce the pierceable barrier 76 and extend into the free ink reservoir 58, as shown in FIG. 1.

After partitioning walls 50 and 54 have been installed and foam material 70 has been placed in chamber 60, but before the lid 14 is fixed to cartridge body 12, a needle (not shown) is inserted into the foam material from the top and ink is injected to saturate the foam material from an ink supply (not shown). A slight negative pressure is applied to the apertures 30 in nozzle plate 28 during filling.

The foam material 70 is not completely saturated with ink. Only enough ink is injected to saturate the layer of foam material in reservoir 60 up to a level indicated by reference numeral 52. The layer of foam material above the level 52 and extending into the air buffer region 62 is left dry. This prevents leakage of ink from reservoir 60 to the exterior of the cartridge through refill opening 72 during shipment and storage. If any ink should seep through the dry foam material it will evaporate, because of its fast drying property, before it reaches refill opening 72.

The free ink reservoir 58 may be filled at the same time that reservoir 60 is filled. Reservoir 58 is filled with ink through a needle inserted into the reservoir through refill opening 72 and septum 76. Preferably, reservoir 58 is not completely filled so that a small amount of air remains in the reservoir.

After the reservoirs 58 and 60 have been filled, the top cover 14 is heat staked or otherwise secured to the cartridge body 12. The filled and primed cartridge is then ready for testing and shipment. The refill opening 72 should not be completely closed until the cartridge is installed on a cartridge carrier and connected to the off-carrier ink supply of a printing device. By leaving refill opening 72 open, ambient pressure is applied to the ink supply the reservoirs 58 and 60 so that any changes in conditions (pressure and/or temperature) tending to create a pressure difference between the ambient environment and the pressure in the reservoirs do not adversely affect cartridge 10. For example, if the ambient pressure decreases or the temperature of the ink in the reservoirs rises, the only effect is that a small quantity of ink in reservoir 58 moves through ink passage 64 and the level of ink rises in reservoir 60 as air escapes through refill opening 72. Ink is not forced from the cartridge through capillary ink passages 21 and apertures 30 because the capillary passages provide a greater resistance to ink flow than the foam material 70.

On the other hand, if the ambient pressure increases or the temperature of the ink in the reservoirs decreases, air is not drawn into the apertures 30 because capillary passages 21 provide a greater resistance to flow than the foam material. In this case, a small quantity of ink is drawn into reservoir 58 from reservoir 60 through ink passage 64 and the level of ink in reservoir 60 drops. Air is drawn in through refill opening 72 to replace the ink drawn from reservoir 60.

Although refill opening 72 should not be completely closed until the cartridge is installed, a plug with a small diameter hole through it may be provided for the opening or the cartridge may be sealed in an airtight plastic bag, to retard or avoid ink evaporation losses.

If desired to reduce the possibility of ink leakage through apertures 30 during shipment and storage, the apertures may be closed by a tape that is removed before the cartridge is installed in a printing device. However, the design of the cartridge is such that closure of apertures 30 is not required. When apertures 30 are left open, ambient pressure is applied to one side of the ink supply in the cartridge via the apertures, capillary ink passages 21, opening 20 and standpipe 18. Since ambient pressure is applied to the opposite side of the ink supply via the refill opening 72, a zero pressure differential is maintained between the pressures on opposite sides of the ink supply.

As the cartridge 10 is installed on cartridge carrier 34, electrical connections to the heater chip 22 from off-carrier control circuits, and a fluid connection between the reservoir 58 and an off-carrier ink supply are simultaneously established. That is, the same movement of the cartridge that causes insertion of the needle 88 into reservoir 58 causes electrical connection of the circuits on tab circuit 24 to the conductors in flexible flat cable 46. The cartridge is thus ready for printing.

Typically, in negative pressure systems where a negative or backpressure in the cartridge siphons ink from an off-board ink reservoir, the flexible ink supply tube 90 is provided with a pinch clamp or other means to resist the siphon action of the external reservoir when the cartridge is removed. While a pinch clamp may be provided for ink supply tube 90, in a preferred embodiment no such clamp is used so the tube 90 will usually have no ink therein when a new cartridge is installed. The volume of air in tube 90 is preferrably slightly less than 1 cc. This may be obtained using a 1 m tube with an internal diameter of 1 mm. At the time the cartridge is installed, air in the hose must expand slightly to match the slight backpressure in the cartridge due to the capillary action in the foam 70. The air expansion causes a small amount of air to enter the free ink reservoir 58. A reasonable backpressure is 4 inches of water, which is about 1% of normal atmospheric pressure. Thus, about 1% of the air in the tube 90, or about 0.01 cc of air, enters the free ink chamber reservoir 58. The level of ink in the foam 70 rises by a similar amount, pulling that volume of ink out of the free ink reservoir. If at the same time the needle 88 is inserted, the foam and air buffer region 62 is sealed from ambient air, the air in the foam and air buffer region is compressed slightly, reducing the negative pressure in the cartridge. The air volume in the foam and the air buffer region must be greater than the volume of tube 90 for the system to work properly. If the air buffer volume is 4 cc and the volume of tube 90 is 1 cc., the pressure rise due to compression of the air in the air buffer region will be ¼ of the pressure drop in the tube due to air expansion therein. That is, if the initial cartridge backpressure is 4 inches of water, the final backpressure will be about 3 inches of water (¾ of 4 inches).

Normally, foam material 70 is a hydrophobic foam material. The portion of the foam material above the free ink level is used as a barrier to limit ink passage into the air buffer region 62, thus preventing leakage of ink from the cartridge through the vent opening 72. Because the initial installation requires a slight rise in the in level in the foam, a small section of the foam above the free ink level must be conditioned to receive ink. This may be accomplished by filling the cartridge in the normal manner, then draining a small amount of ink from the foam. This may be conveniently done during initial filling and testing of the cartridge.

During printing, ink is drawn from reservoir 58 through the opening 20 each time the heaters in heater chip 22 cool. As ink is sucked from reservoir 58, the pressure therein tends to decrease and if needle 88 and ink supply line 90 are full of ink, replenishment ink is drawn into the reservoir from the off-board ink supply 94 so that the level of ink in reservoir 58 remains substantially constant.

Initially however, needle 88 and ink supply tube 90 are empty as described above so air is drawn into the reservoir 58. The level of the ink in reservoir 58 drops, and continues to drop during printing, until all of the air has been sucked from the supply tube. The ink level in reservoir 58 then stabilizes as replacement ink begins entering the reservoir. The volume of reservoir 58 must be large enough so that the level of ink in the reservoir never drops below the level of needle 88. That is, the volume of the reservoir must be significantly greater than the volume of ink supply tube 90. This avoids meniscus effects and keeps air out of the ink supply tube.

Figure 3:
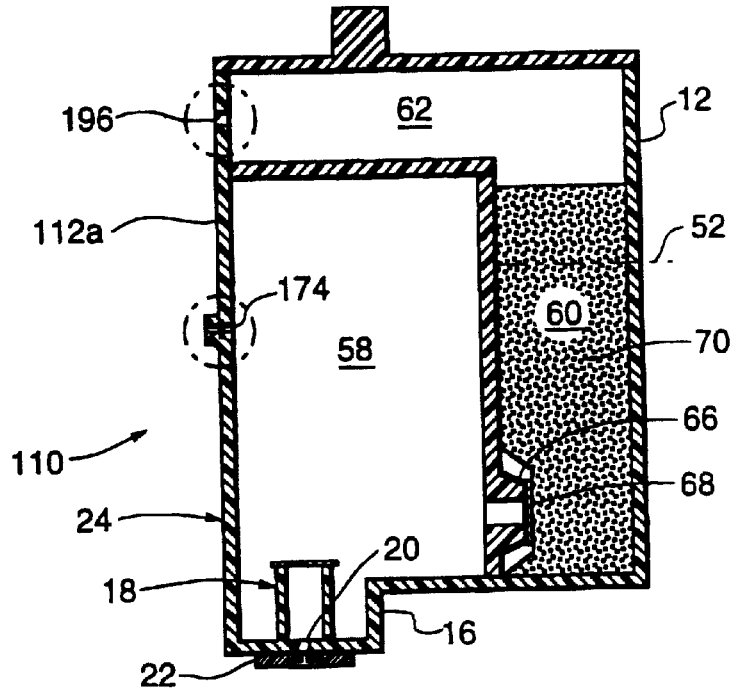
FIG. 3 is a sectional view of a second embodiment wherein separate openings are provided in the cartridge wall, one opening serving as a vent and the other opening providing a passage for replenishment ink.
Figure 4:
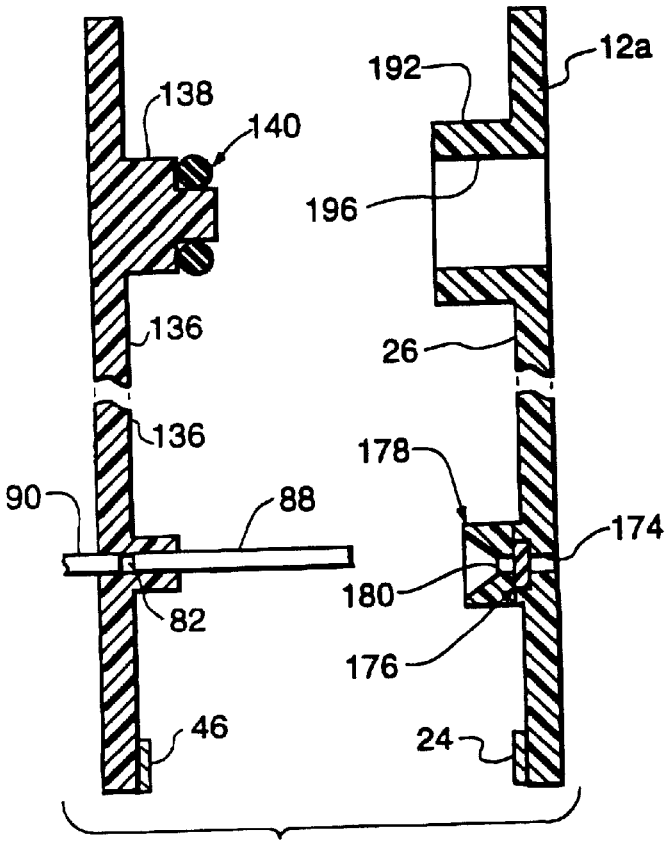
FIG. 4 is an enlarged view of the circled portions of FIG. 3 and further showing the cartridge separated from the cartridge carrier; and, FIG. 5 is a view similar to FIG. 4 but showing the relationship of the cartridge and cartridge carrier when the cartridge is fully mounted on the cartridge carrier.
Figure 5:
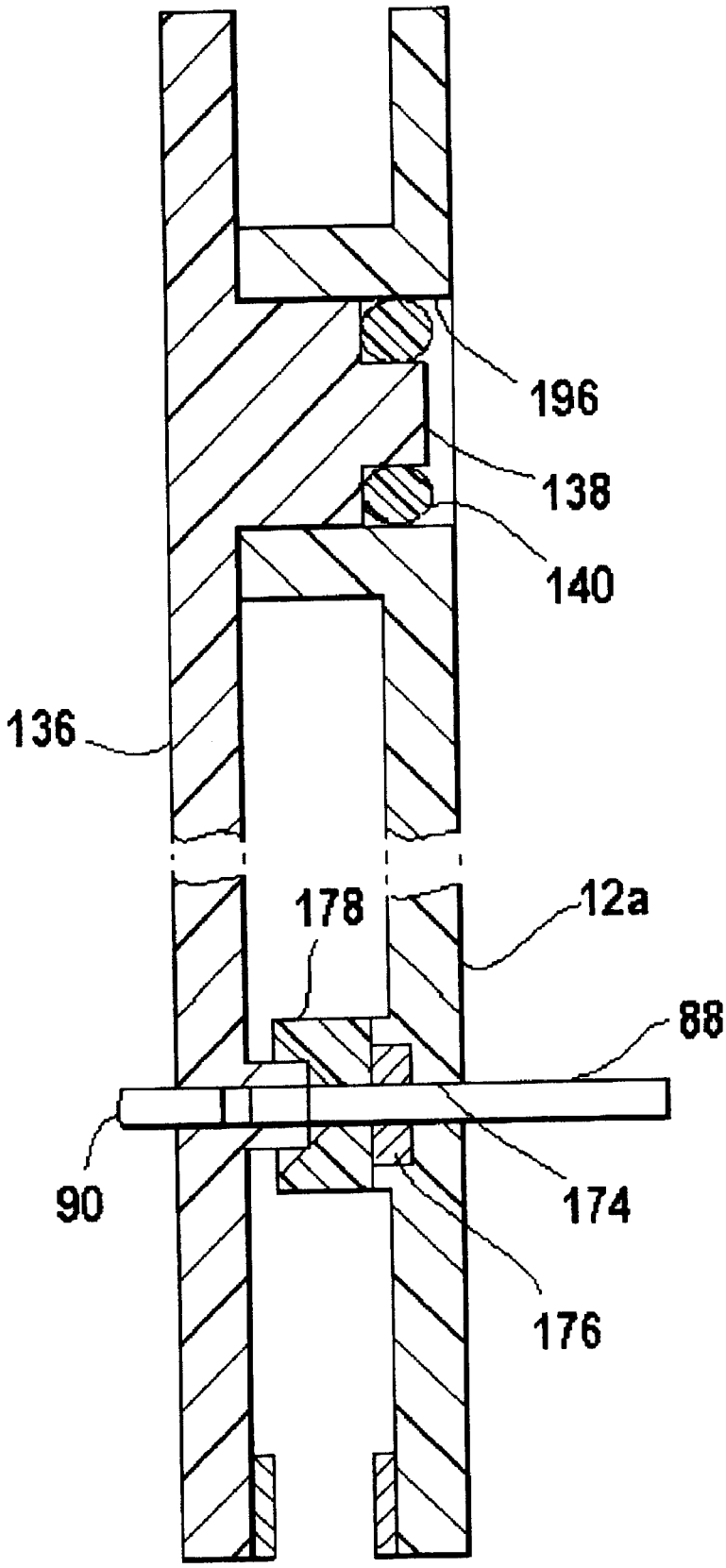

In the embodiment shown in FIGS. 1 and 2 the refill opening 72 also serves as a vent opening prior to the time the cartridge 10 is mounted on the cartridge carrier 34. FIGS. 3 and 4 illustrate an embodiment of the invention wherein a cartridge 110 is provided with a refill opening 174 and a separate vent opening 196, both extending through wall 12*a* of cartridge body 12. Vent opening 196 extends through a boss 192 and opens into the air buffer region 62. The cartridge 110 is similar to the cartridge 10 and like elements bear like reference numerals in the drawings.

The exterior surface of wall 12*a* is recessed around refill opening 174 and a pierceable barrier 176 is inserted into the recess to seal the refill opening. A needle guide 178, having an opening 180 extending therethrough, is secured to the outer surface 26 of wall 12*a* with opening 180 axially aligned with refill opening 174.

In FIG. 4, the element 136 is the cartridge carrier vertical leg and corresponds to the vertical leg 36 of FIGS. 1 and 2. The vertical leg 136 is provided with a stepped boss 138 and an O-ring 140 surrounds the smaller diameter portion of the boss. As cartridge 110 is mounted on the carrier, the boss 138 enters vent opening 196 and the O-ring forms an air-tight seal between the boss and the interior surface of boss 192.

The carrier vertical leg 136 is also provided with an opening 82. An ink supply tube 90 is inserted into opening 82 from one side and a hollow needle is inserted into the opening from the opposite side.

The vent opening 196 is left open during shipment and storage while the pierceable barrier seals refill opening 174. This permits ambient pressure to be applied to one side of the ink supply in the cartridge to counterbalance the ambient pressure applied to the other side of the ink supply via opening 20. The cartridge 110 thus responds to changes in ink temperature and ambient pressure in the same way as previously explained with reference to cartridge 10.

As cartridge 110 is mounted on the cartridge carrier, needle 88 slides through the needle guide 178 and pierces the barrier 176 thus connecting the off-board ink supply to the free ink reservoir 58. At the same time, boss 138 slides into vent opening 192 and O-ring 140 seals the opening so that ambient pressure is no longer applied to the interior of the cartridge through the opening. Concurrently with these actions, the printed circuits on tab circuit 24 move into contact with the conductors in flat cable 46 so that the heaters on the cartridge are connected to control circuits located off-board the cartridge carrier.

During printing, cartridge 110 functions in exactly the same manner as cartridge 10. From the foregoing description it is seen that the invention provides a cartridge having many advantages over prior art cartridges. It may be filled and tested at the factory thus removing the burden of these operations from the user. There is no leakage of ink from the cartridge even though the refill opening through which the cartridge is refilled during use is left open. The cartridge requires no handling of the ink supply line to the off-carrier ink supply because it is connected to the cartridge carrier rather than the cartridge. User contact with ink is further minimized because the elastic barrier wipes ink from the ink supply needle as the cartridge is removed from its carrier. Finally, the simple act of mounting the cartridge on the carrier simultaneously establishes the necessary fluid and electrical connections to the cartridge.

Although preferred embodiments have been described in detail to illustrate the principles of the invention, it will be understood that various modifications may be made in the described embodiments without departing from the spirit and scope of the invention as defined by the appended claims.

We claim:

1. A refillable ink cartridge having an interior divided by partitions into a free ink reservoir, a foam-filled ink reservoir, and an air buffer region; an ink passage permitting flow of ink between said foam-filled ink reservoir and said free ink reservoir; heaters mounted on a first outer wall for ejecting ink from said free ink reservoir during printing, said cartridge having a tab circuit mounted on a second outer wall and connected to said heaters for connecting said heaters to a source of energizing signals; said second outer wall having an opening therein through which replenishment ink may be drawn into said free ink reservoir from an off-board ink supply during printing, whereby said heaters may be connected to the source of energizing signals simultaneously with connection of said free ink reservoir to the off-board ink supply.

2. A refillable ink cartridge as claimed in claim 1 wherein said opening is closed with a pierceable elastic barrier, said cartridge also having a vent opening in said second wall for admitting ambient pressure to said air buffer region during shipment and storage of said cartridge.

3. A refillable ink cartridge as claimed in claim 2 in combination with a cartridge carrier on which said cartridge is mounted, said cartridge carrier having a wall portion supporting a flexible flat cable, a through-hole extending through said wall portion, said through hole having a hollow needle extending therefrom on a first side of said wall portion and an ink supply line extending therefrom on a second side of said wall portion, said flexible flat cable making electrical contact with said tab circuit and said hollow needle extending through said pierceable barrier as said cartridge is mounted on said cartridge carrier.

4. A refillable ink cartridge as claimed in claim 3 and further comprising a boss on said wall portion of said cartridge carrier and an O-ring surrounding said boss, said boss extending into said vent opening to provide an air-tight seal for said vent opening as said cartridge is mounted on said cartridge carrier.

5. A refillable ink cartridge as claimed in claim 1 in combination with a cartridge carrier on which said cartridge is mounted, said cartridge carrier having a wall portion supporting a flexible flat cable, a through-hole extending through said wall portion, said through hole having a hollow needle extending therefrom on a first side of said wall portion and an ink supply line extending therefrom on a second side of said wall portion, said flexible flat cable making electrical contact with said tab circuit and said hollow needle extending through said opening as said cartridge is mounted on said cartridge carrier.

6. A refillable ink cartridge having an interior divided by partitions into a free ink reservoir, a foam-filled ink reservoir, and an air buffer region; an ink passage permitting flow of ink between said foam-filled ink reservoir and said free ink reservoir; heaters mounted on a first outer wall for ejecting ink from said free ink reservoir during printing, said cartridge having a tab circuit mounted on a second outer wall and connected to said heaters; said second outer wall having an opening therein through which replenishment ink may be drawn into said free ink reservoir during printing, said opening being a vent opening for admitting ambient pressure to said air buffer region during shipment and storage of said cartridge, said cartridge having a refill opening in one of said partitions separating said air buffer region from said free ink reservoir, said refill opening being axially aligned with said vent opening and sealed by a pierceable elastic barrier, said opening being a vent opening for admitting ambient pressure to said air buffer region during shipment and storage of said cartridge, said cartridge having a refill opening in one of said partitions separating said air buffer region from said free ink reservoir, said refill opening being axially aligned with said vent opening and sealed by a pierceable elastic barrier.

7. A refillable ink cartridge as claimed in claim 6 in combination with a cartridge carrier on which said cartridge is mounted, said cartridge carrier having a wall portion supporting a flexible flat cable, a through-hole extending through said wall portion, said through hole having a hollow needle extending therefrom on a first side of said wall portion and an ink supply line extending therefrom on a second side of said wall portion, said flexible flat cable making electrical contact with said tab circuit and said hollow needle extending through said vent opening and said pierceable barrier as said cartridge is mounted on said cartridge carrier.

8. A refillable ink cartridge and cartridge carrier as claimed in claim 7 wherein said wall portion of said cartridge carrier has a boss thereon which extends into said vent opening as said cartridge is mounted on said cartridge carrier.

9. A refillable ink cartridge and cartridge carrier as claimed in claim 8 wherein an O-ring surrounds said boss.

* * * * *